US005749581A

United States Patent [19]

Poisson

[11] Patent Number: 5,749,581

[45] Date of Patent: May 12, 1998

[54] APPARATUS AND METHOD OF PLAYING A BASKETBALL BOARD GAME

[76] Inventor: Renald Poisson, 13223 Champions Centre Dr., #266, Houston, Tex. 77069

[21] Appl. No.: 697,021

[22] Filed: Aug. 16, 1996

[51] Int. Cl.[6] ..... A63F 3/00

[52] U.S. Cl. ..... 273/244; 273/298

[58] Field of Search ..... 273/244, 298, 273/259, 277

[56] References Cited

U.S. PATENT DOCUMENTS

| | | | |
|---|---|---|---|
| 3,545,763 | 12/1970 | Seitz | 273/244 |
| 3,941,386 | 3/1976 | Nelson | 273/244 |
| 4,186,928 | 2/1980 | Hunt, Jr. | 273/244 |
| 5,472,191 | 12/1995 | Hendricks | 273/244 |

*Primary Examiner*—Benjamin H. Layno

[57] ABSTRACT

A method for playing a basketball board game is shown. The method includes, providing a deck of passing cards, a deck of rebound cards, a deck of foul shot cards and a deck of playing cards. At least a portion of the passing deck, the rebound deck, and the playing deck carries instructions for their use to replicate the progress of a basketball game. A like plurality of cards are dealt from the playing deck to each of two players. An offense player and a defense player are declared by a coin toss or some other means. The plurality of cards dealt to the offense player are an offense playing hand and the plurality of cards dealt to the defense player are a defense playing hand. The passing deck of cards is dealt to the offense player. A game system with a basketball game board having a representation of a basketball court thereon including two basketball goals, a center court position, two paint areas, a plurality of playing positions is also disclosed. Each of the plurality of playing positions are connected to other of the playing positions by a plurality of connecting lines so that any two playing positions are connected only by a single line.

49 Claims, 7 Drawing Sheets

APPARATUS AND METHOD OF PLAYING A BASKETBALL BOARD GAME

BACKGROUND OF THE INVENTION

This invention relates to a basketball board game. More specifically, this invention relates to a basketball board game that closely follows how professional basketball games are played.

OBJECTS OF THE INVENTION

It is an object of the present invention to provide a basketball board game that is similar to the major league game of basketball that can be played in an intimate setting.

It is another object of the present invention to provide a basketball board game that incorporates the key elements of popular card games like; the finesse of bridge, the bluffing of poker, the card counting concept of pinnocle, and the confrontation of battle or war.

It is another object of the present invention to provide a board game that is self-sustaining in that the game uses no dice, spinners, statistics or mechanical devices to depict the outcome of the game.

SUMMARY OF THE INVENTION

In one embodiment of the present invention, there is provided a method for playing a basketball board game. The method includes, providing a deck of passing cards, a deck of rebound cards, a deck of foul shot cards and a deck of playing cards. At least a portion of the passing deck, the rebound deck, and the playing deck carries instructions for their use to replicate the progress of a basketball game. A like plurality of cards are dealt from the playing deck to each of two players. An offense player and a defense player are declared by a coin toss or some other means. The plurality of cards dealt to the offense player are an offense playing hand and the plurality of cards dealt to the defense player are a defense playing hand. The passing deck of cards is dealt to the offense player.

The passing deck of cards comprises a plurality of pass cards selected from the group consisting of: bounce pass, chest pass, cross court pass, full court pass, behind the back pass, and alley oop pass. The rebound deck of cards comprises a plurality of rebound cards being selected from the group consisting of: offensive rebound, and defensive rebound. The foul shot deck of cards comprises a plurality of foul shooting cards being selected from the group consisting of: foul shot no good, and foul shot good.

The playing deck of cards comprises a plurality of situation play cards, a plurality of offense cards and a plurality of defense cards. The plurality of situation play cards are selected from the group consisting of: steal, block shot, jump ball, traveling, non-shooting foul, shooting foul, technical foul, and illegal defense. The plurality of offense cards are selected from the group consisting of: lay up, slam dunk, jump hook, sky hook, 10 foot jump shot, 15 foot jump shot, 20 foot jump shot, and 3 point shot. The plurality of defense cards are selected from the group consisting of: lay up no good, slam dunk no good, jump hook no good, sky hook no good, 10 foot jump shot no good, 15 foot jump shot no good, 20 foot jump shot no good, and 3 point shot no good.

To begin the game, a pass card is played by the offense player from the passing deck of cards. At this point, the defense player has several options with which to respond to the offense play.

In another embodiment, there is provided a game system with a basketball game board having a representation of a basketball court thereon including two basketball goals, a center court position, two paint areas, a plurality of playing positions. Each of the plurality of playing positions are connected to other of the playing positions by a plurality of connecting lines so that any two playing positions are connected only by a single line. The plurality of playing positions include a plurality of shot positions and the connecting lines represent passing lanes.

A deck of passing cards, a deck of rebound cards, a deck of foul shot cards and a deck of playing cards are provided to play a basketball game. At least a portion of the passing deck, the rebound deck, and the playing deck carries instructions for their use to replicate the progress of a basketball game.

DETAILED DESCRIPTION OF THE PREFERRED EMBODIMENTS

Figure 4:
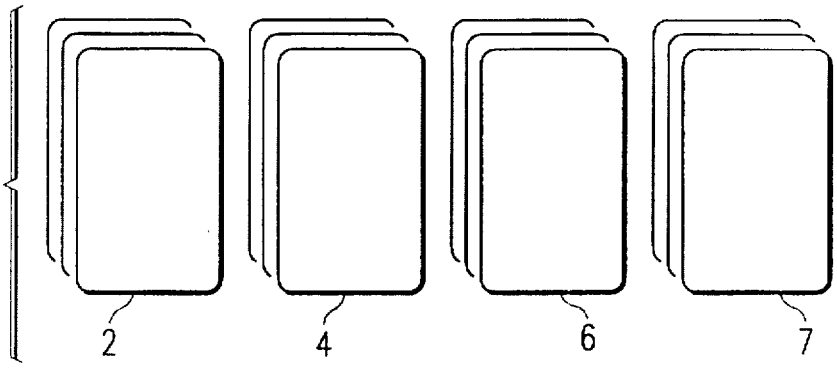
FIG. 4 is a pictorial view of various playing decks used in the game.

In one embodiment of the present invention, there is provided a method for playing a basketball board game. The method includes, providing a deck of passing cards 2, a deck of rebound cards 4, a deck of foul shot cards 6 and a deck of playing cards 7. (See FIG. 4) At least a portion of the passing deck 2, the rebound deck 4, and the playing deck 8 carries instructions for their use to replicate the progress of a basketball game. A like plurality of cards are dealt from the playing deck 8 to each of two players. An offense player and a defense player are declared by a coin toss or some other means. The plurality of cards dealt to the offense player are an offense playing hand and the plurality of cards dealt to the defense player are a defense playing hand. The passing deck of cards 2 is dealt to the offense player.

Figure 5:
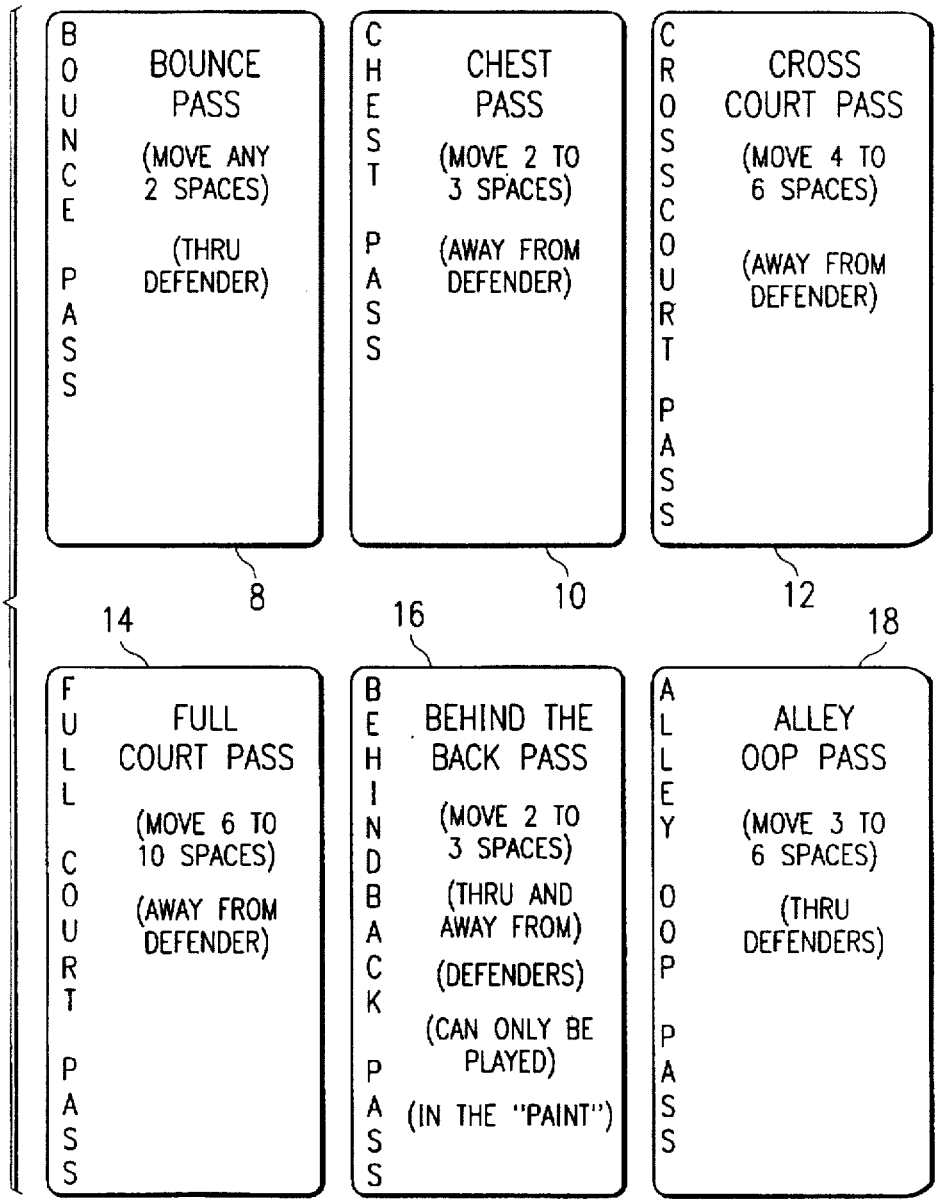
FIG. 5 is a top view of the passing deck.
Figure 6:
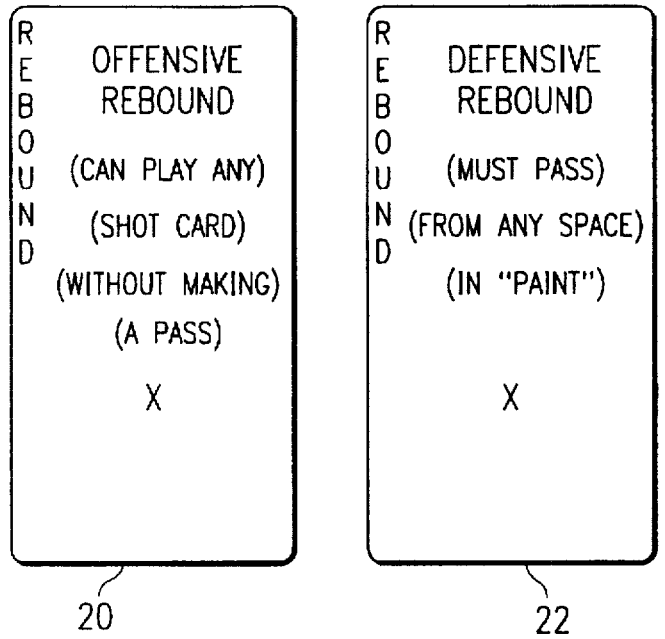
FIG. 6 is a top view of the rebound cards.
Figure 7:
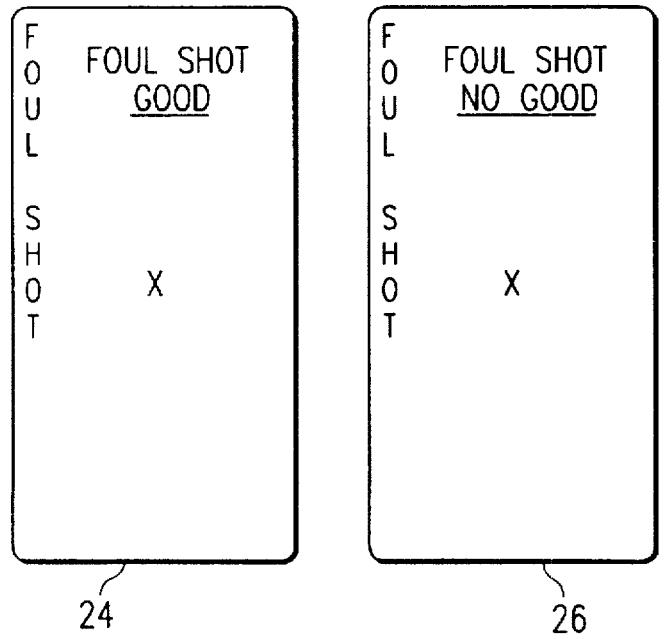
FIG. 7 is a top view of the foul shooting cards.

The passing deck of cards 2 comprises a plurality of pass cards selected from the group consisting of: bounce pass 8, chest pass 10, cross court pass 12, full court pass 14, behind the back pass 16, and alley oop pass 18. (See FIG. 5) The rebound deck of cards 4 comprises a plurality of rebound cards being selected from the group consisting of: offensive rebound 20, and defensive rebound 22. (See FIG. 6) The foul shot deck of cards comprises a plurality of foul shooting cards being selected from the group consisting of: foul shot no good 24, and foul shot good 26. (See FIG. 7)

Figure 8:
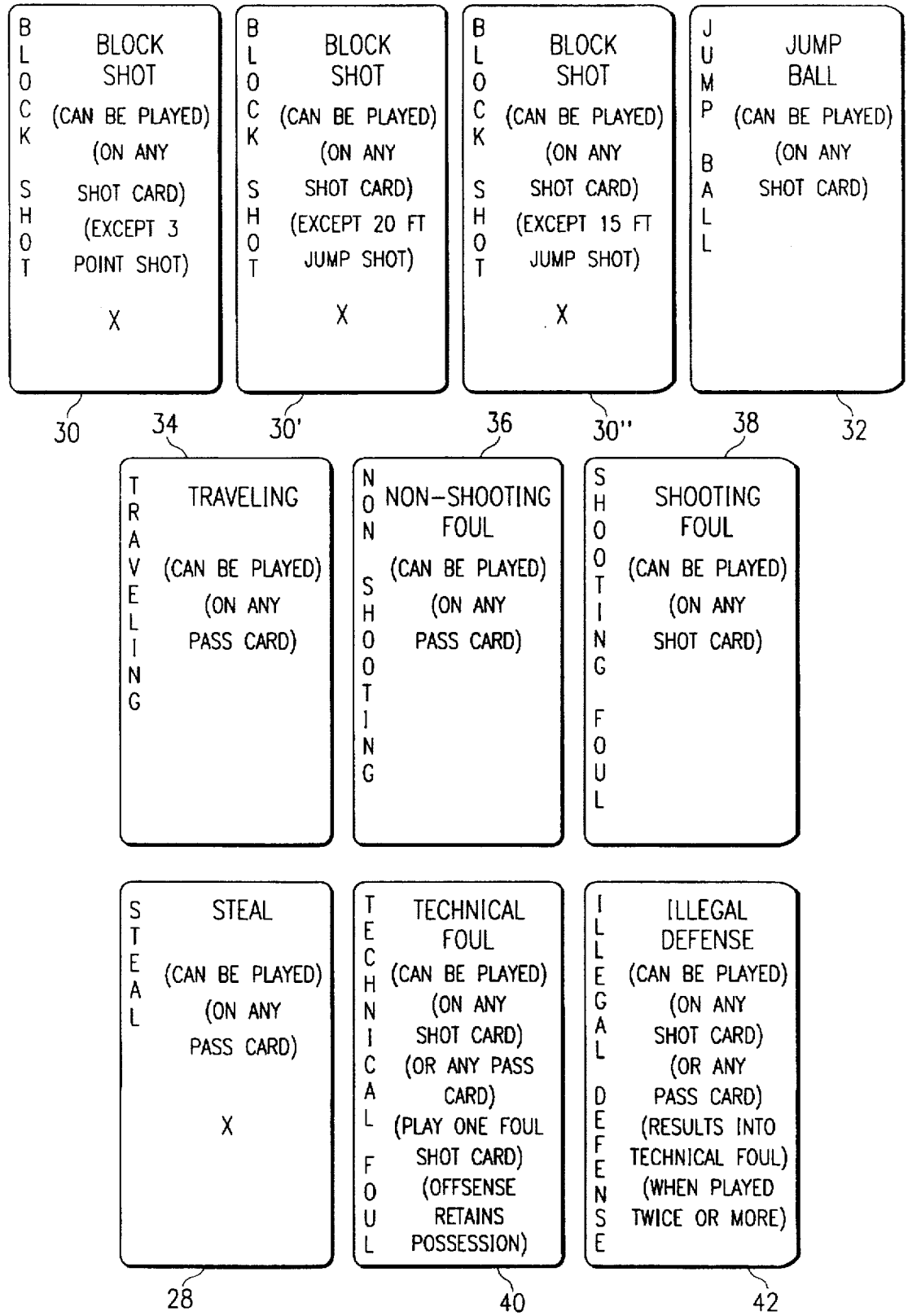
FIG. 8 is a top view of the situation play cards.
Figure 9:
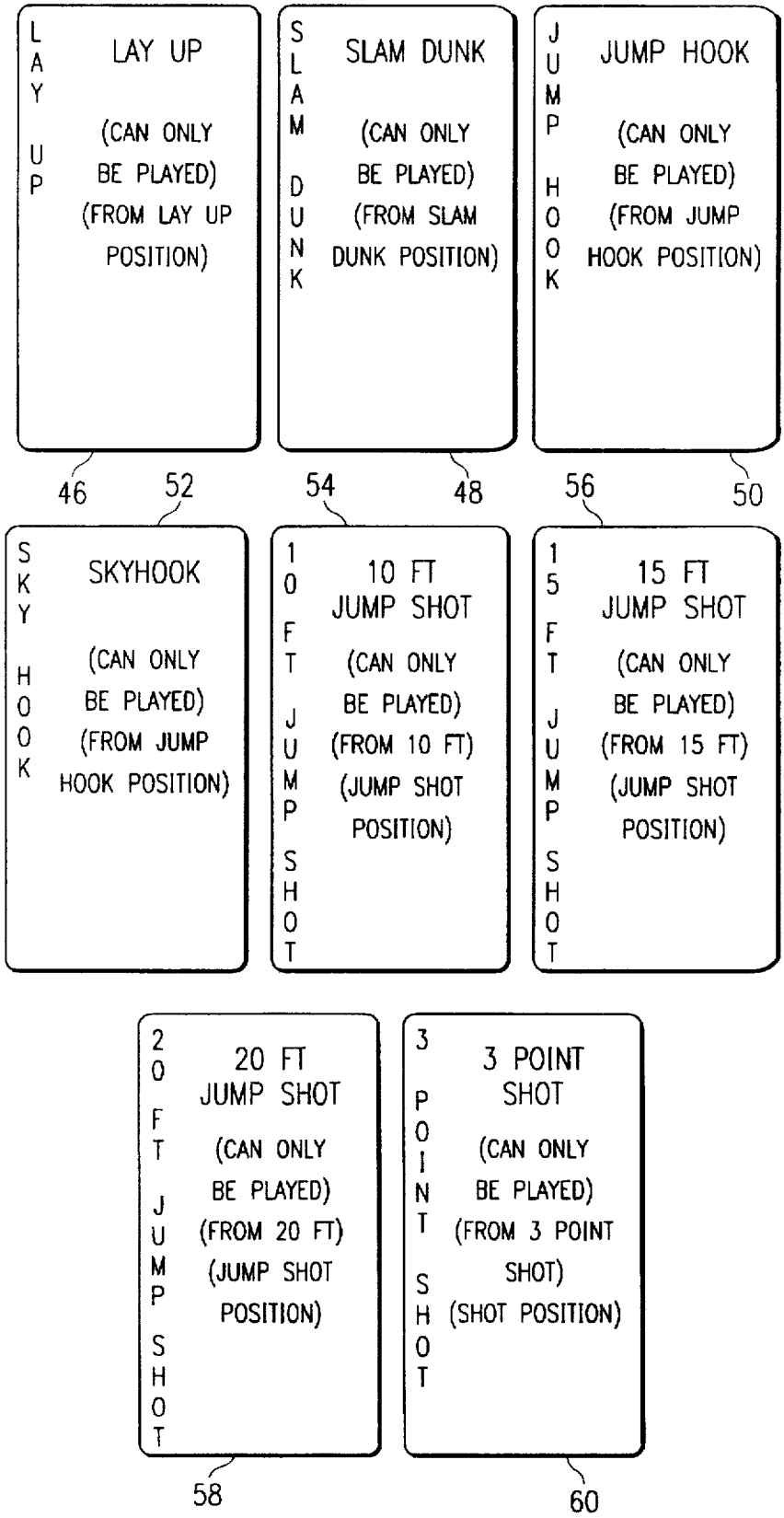
FIG. 9 is a top view of the offense cards.
Figure 10:
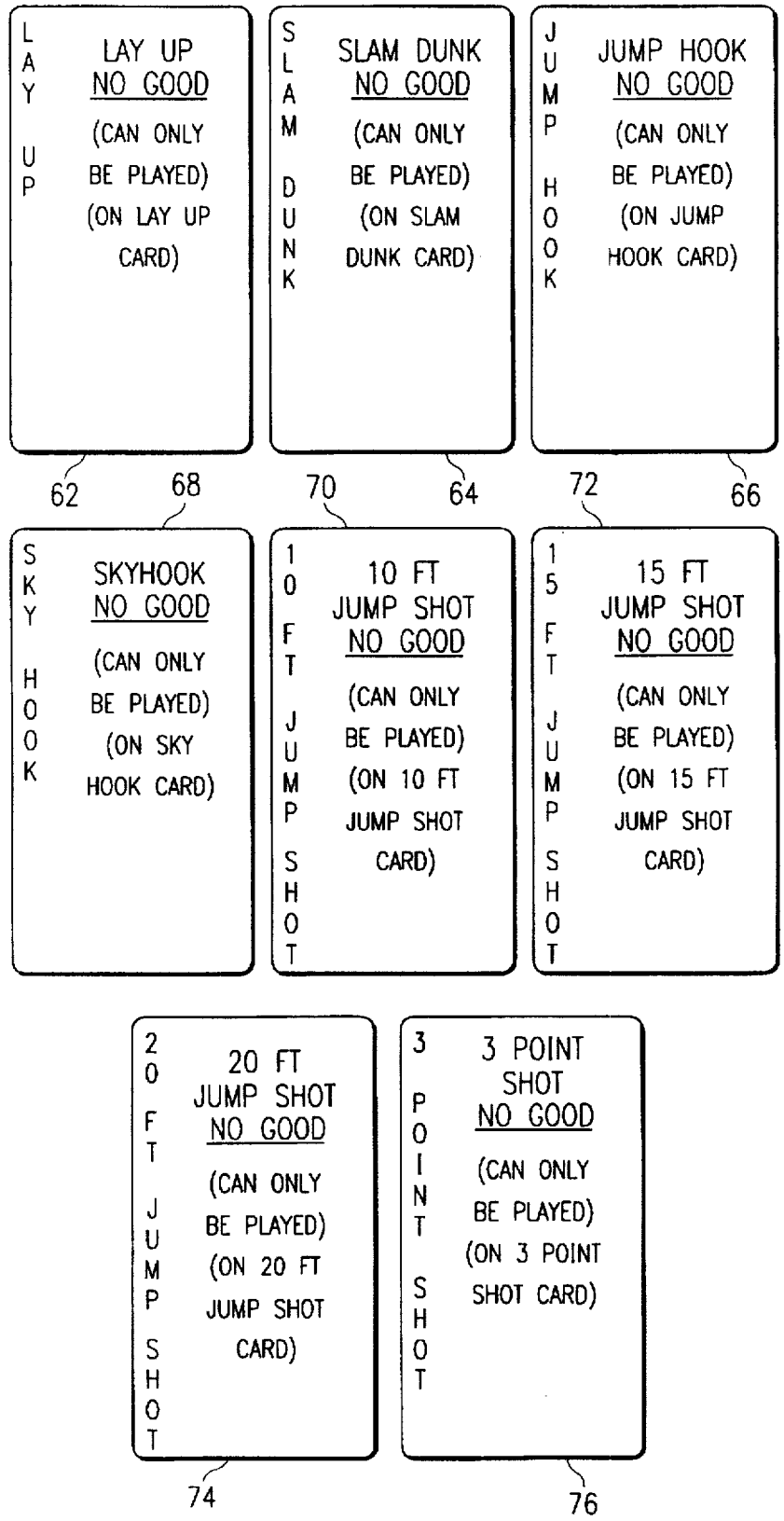
FIG. 10 is a top view of the defense cards.

The playing deck of cards comprises a plurality of situation play cards, a plurality of offense cards and a plurality of defense cards. The plurality of situation play cards are selected from the group consisting of: steal 28, block shot 30, 30', and 30", jump ball 32, traveling 34, non-shooting foul 36, shooting foul 38, technical foul 40, and illegal defense 42. (See FIG. 8) The plurality of offense cards are selected from the group consisting of: lay up 46, slam dunk 48, jump hook 50, sky hook 52, 10 foot jump shot 54, 15 foot jump shot 56, 20 foot jump shot 58, and 3 point shot 60. (See FIG. 9) The plurality of defense cards are selected from the group consisting of: lay up no good 62, slam dunk no good 64, jump hook no good 66, sky hook no good 68, 10 foot jump shot no good 70, 15 foot jump shot no good 72, 20 foot jump shot no good 74, and 3 point shot no good 76. (See FIG. 10)

To begin the game, a pass card is played by the offense player from the deck of passing cards 2. At this point, the defense player has several options with which to respond to the offense play.

Figure 1:
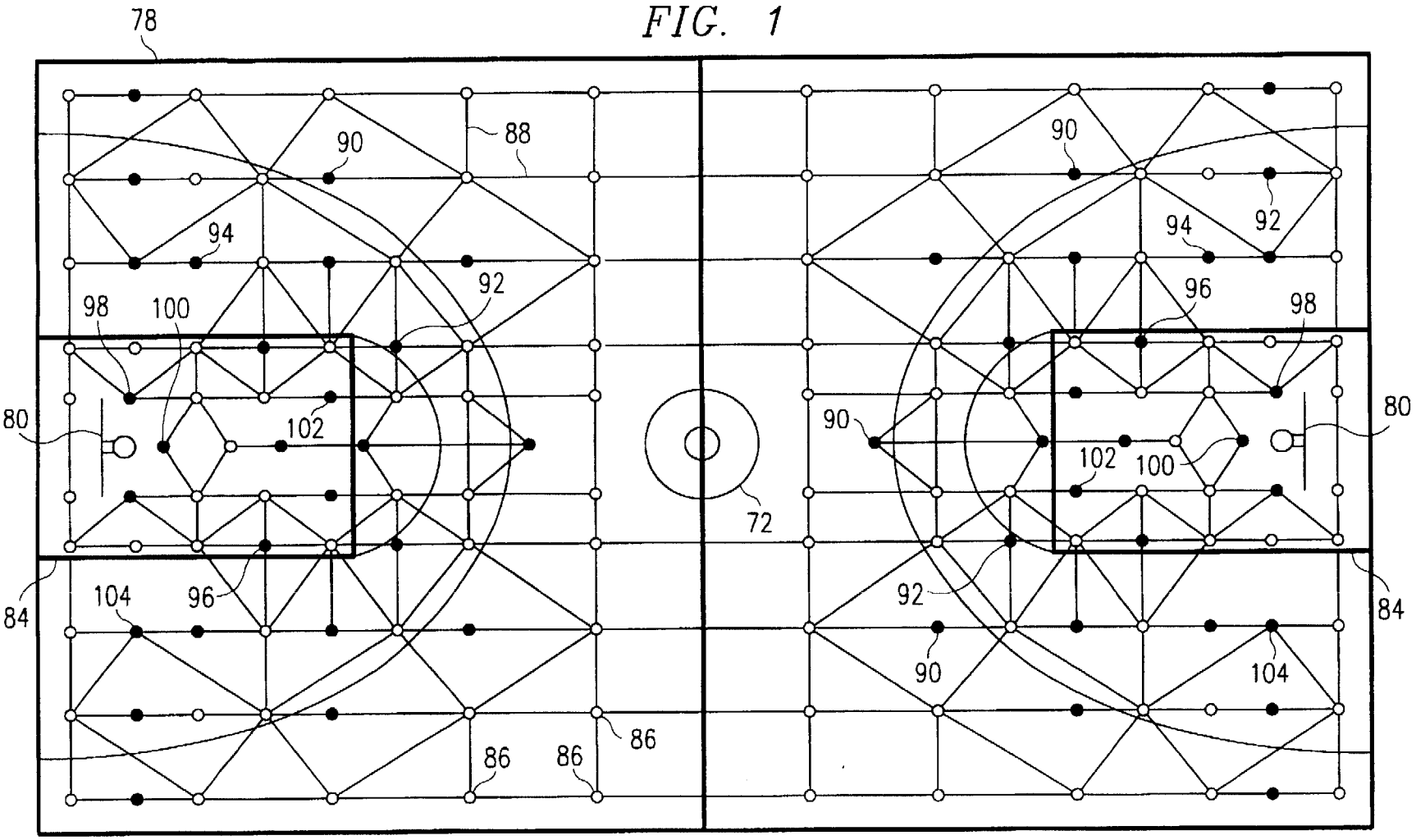
FIG. 1 is a top view of the basketball board used in the game.

In a preferred embodiment, a basketball game board 78 is provided. (See FIG. 1) The basketball game board 78 has a representation of a basketball court thereon including two basketball goals 80, a center court position 82, two paint areas 84, and a plurality of playing positions 86. Each of the plurality of playing positions is connected to other of the playing positions by a plurality of connecting lines 88. Any two playing positions are connected only by a single connecting line. The connecting lines 88 represent passing lanes for the purpose of directing the game ball and the defense team players movement. The plurality of playing positions include a plurality of shot positions.

The shot positions are selected from the group consisting of at least one 3 point jump shot position 90, at least one 20 foot jump shot position 92, at least one 15 foot jump shot position 94, at least one 10 foot jump shot position 96, at least one lay up position 98, at least one slam dunk position 100, at least one jump hook position 102, and at least one sky hook position 104.

Figure 2:
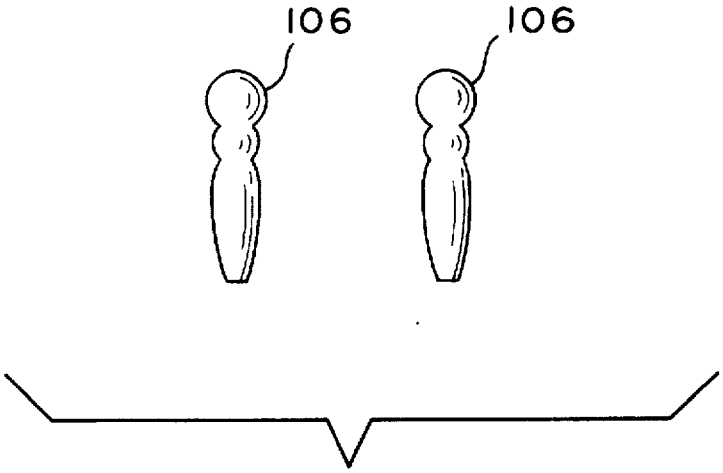
FIG. 2 is a pictorial view of a game piece.
Figure 3:
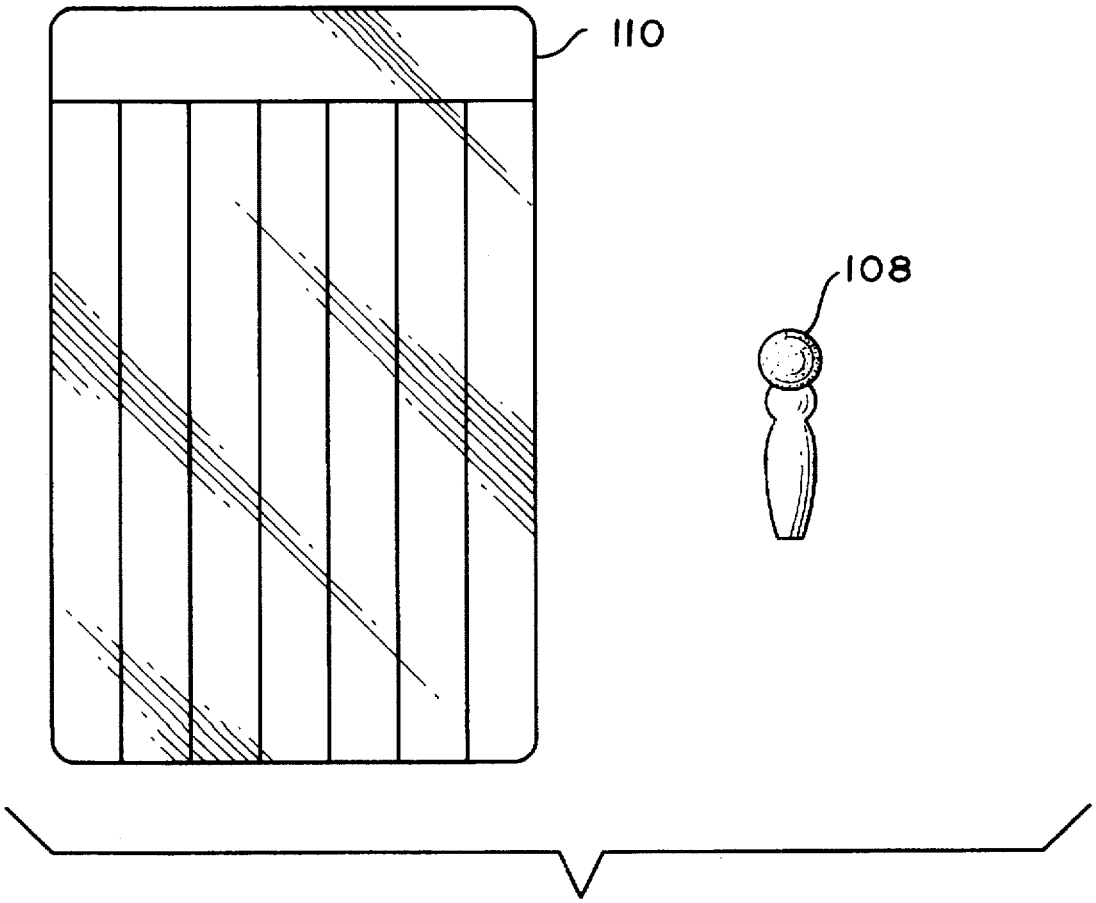
FIG. 3 is a pictorial view of a game piece representing the game ball and a tabular means.

There are a plurality of game pieces 106 representing members of a defense team, a game piece representing a game ball 108, and a tabular means 110 to record points, fouls, shot attempts, blocks, steals, rebounds, and quarters. (See FIGS. 2 and 3) The offense player can also have game pieces representing an offense team.

In playing the game, once the offense player has played a pass card, a situation play card from the defense playing hand can be played by the defense player responsively to the pass card. The defense player then draws a replacement card from the playing deck 8. If the defense play was good, the game ball 108 is turned over to the defense player in response to the situation play card. In this case, the defense player becomes the offense player and the offense player becomes the defense player.

In a preferred embodiment, the offense player moves the game ball 108 a specified number of positions along the passing lanes. The offense player moves the game ball 108 in accordance with a set of instructions on the pass card played. The defense team is then allowed to move one of the defense team members along the passing lanes in response to the game ball 108 being moved by the offense player in order to block the offensive play. The offense player then plays a shot card from the offense playing hand. The offense player then draws a replacement card from the playing deck 8. The defense player then can discard a card from the defense playing hand and draw a replacement card from the playing deck 8. In this situation, the offense player is awarded a number of points indicated on the shot card played by the offense player. The game ball 108 is then turned over to the defense player, and the defense player becomes the offense player and the offense player becomes the defense player.

Alternatively, the defense player can play a card from the defense playing hand in response to the shot card played by the offense player and draw a replacement card from the playing deck 8. If the card played by the defense player is a shot no good card, the defense player can play a rebound card from the rebound deck. If the rebound card is a defensive rebound 22 card, the game ball is turned over to the defense player so that the defense player becomes the offense player and the offense player becomes the defense player.

In another alternative, the defense player can play a shot no good card. In this instance, a rebound card is played from the rebound deck by the offense player. The rebound card is an offensive rebound 20 card and is played by the offense player. Then the offense player plays a shot card and the game continues.

In a preferred embodiment, the offensive player can only play two pass cards while being positioned in the paint area. The bounce pass card 8 carries instructions to move the game ball 108 any two positions, along the passing lanes, notwithstanding the presence of a defense player. The chest pass card 10 carries instructions to move the game ball 108 two to three positions, along the passing lanes, away from the defense player. The chest pass card 10 can carry instructions to move the game ball 108 one to two positions, along the passing lanes, away from the defense player. The cross court pass card 12 carries instructions to move the game ball 108 four to six positions, along the passing lanes, away from the defense player. The full court pass card 14 carries instructions to move the game ball 108 six to ten positions, along the passing lanes, away from the defense player. The behind the back pass card 16 carries instructions to move the game ball 108 two to three positions, along the passing lanes, away from the defense player, said behind the back pass card 16 being played only in the paint area. The alley oop pass card 18 carries instructions to move the game ball 108 three to six positions, along the passing lanes, notwithstanding the presence of a defense player.

Preferably, the offensive rebound 20 card carries instructions to play any shot without making a pass. The defensive rebound 22 card can carry instructions that the game ball 108 must be passed from any space in the paint area. The steal 28 card can be played in response to any pass card.

In a preferred embodiment, the block shot card is selected from the group consisting of: a block shot played in response to any shot except a three point shot card 30, a block shot played in response to any shot except a twenty foot jump shot card 30', and a block shot played in response to any shot card except a fifteen foot jump shot card 30". The jump ball 32 card can be played in response to any shot card. The traveling 34 card can be played in response to any pass card. The non-shooting foul 36 card can be played in response to any pass card. The shooting foul 38 card can be played in response to any shot card. The technical foul 40 card can be played in response to any shot card or any pass card. When a foul shot card is played, the offense player retains possession of the game ball 108.

The illegal defense 42 card can be played in response to any shot card or any pass card, wherein when the illegal defense 42 card is played more than twice, a technical foul results.

The lay up 46 card can only be played from a lay up position 98. The slam dunk card 48 can only be played from a slam dunk position 100. The jump hook card 50 can only be played from a jump hook position 102. The sky hook card 52 can only be played from a sky hook position 104. The 10 foot jump shot card 54 can only be played from a 10 foot jump shot position 96. The 15 foot jump shot card 56 can only be played from a 15 foot jump shot position 94. The 20 foot jump shot card 58 can only be played from a 20 foot jump shot position. The 3 point shot card 60 can only be played from a 3 point jump shot position 90.

The lay up no good card 62 can only be played in response to a lay up card 46. The slam dunk no good card 64 can only be played in response to a slam dunk card 48. The jump hook no good card 66 can only be played in response to a jump hook card 50. The sky hook no good card 68 can only be played in response to a sky hook card 52. The 10 foot jump shot no good card 70 can only be played in response to a 10 foot jump shot card 54. The 15 foot jump shot no good card 72 can only be played in response to a 15 foot jump shot card 56. The 20 foot jump shot no good card 74 can only be played in response to a 20 foot jump shot card 58. The 3 point shot no good card 76 can only be played in response to a 3 point shot card 60.

When using foul shot cards, the defense player can play a shooting foul 38 shot card. In this situation, the offense player is allowed to play two foul shot cards from the foul shooting deck. Alternatively, when the defense player plays a shooting foul 38 shot card, the point made by the defense player is discounted. In another alternative, the defense player can play a shooting foul 38 shot card, and the offense player is allowed to play three foul shot cards from the foul shooting deck. When the shooting foul 38 shot card is played by the offense player, the ball is put into play by the offense player.

A technical foul 40 shot card can be played by the defense player in response to a shot card or a pass card played by the offense player and the offense player is allowed to play a foul shooting card.

In another embodiment, there is provided a game system with a basketball game board having a representation of a basketball court thereon including two basketball goals, a center court position, two paint areas, a plurality of playing positions. Each of the plurality of playing positions are connected to other of the playing positions by a plurality of connecting lines so that any two playing positions are connected only by a single line. The plurality of playing positions include a plurality of shot positions and the connecting lines represent passing lanes.

A deck of passing cards 2, a deck of rebound cards 4, a deck of foul shot cards 6 and a deck of playing cards 7 are provided to play a basketball game. At least a portion of the passing deck, the rebound deck, and the playing deck carries instructions for their use to replicate the progress of a basketball game.

Preferably, the passing deck of cards 2 comprises a plurality of pass cards selected from the group consisting of: bounce pass 8, chest pass 10, cross court pass 12, full court pass 14, behind the back pass 16, and alley oop pass 18. (See FIG. 5) The rebound deck of cards 4 comprises a plurality of rebound cards being selected from the group consisting of: offensive rebound 20, and defensive rebound 22. (See FIG. 6) The foul shot deck of cards comprises a plurality of foul shooting cards being selected from the group consisting of: foul shot no good 24, and foul shot good 26. (See FIG. 7)

Preferably, the playing deck of cards 7 comprises a plurality of situation play cards, a plurality of offense cards and a plurality of defense cards. The plurality of situation play cards are selected from the group consisting of: steal 28, block shot 30, 30', and 30", jump ball 32, traveling 34, non-shooting foul 36, shooting foul 38, technical foul 40, and illegal defense 42. (See FIG. 8) The plurality of offense cards are selected from the group consisting of: lay up 46, slam dunk 48, jump hook 50, sky hook 52, 10 foot jump shot 54, 15 foot jump shot 56, 20 foot jump shot 58, and 3 point shot 60. (See FIG. 9) The plurality of defense cards are selected from the group consisting of lay up no good 62, slam dunk no good 64, jump hook no good 66, sky hook no good 68, 10 foot jump shot no good 70, 15 foot jump shot no good 72, 20 foot jump shot no good 74, and 3 point shot no good 76. (See FIG. 10)

EXAMPLE

The following example is meant for illustrative purposes only and in no way is intended to limit the scope of the claims.

In general the basketball board game parallels that of the original game, with a few exceptions. Such differences are for the most part, necessitated by the requirements of a board game as opposed to actual, physical play. For example, in the true game, if a player pumps the referee when a foul is called he would be ejected from the game and have to pay a fine. In this game, of course, there is no referee so this aspect of the true game would not apply here.

To play the game, arrange the game on any suitable playing surface. Place brass pegs in their respective locations on the basketball court keeping in mind that only one peg is needed to represent the game ball 108 and that this peg can be marked with a white stripe.

The cards can be color-coded for easier quicker play. For example, defense cards are red, offense cards are green, pass cards are yellow etc. A red defense card is played against a green offense card, unless the offense team plays a defense card against itself Playing a defense card against itself while on offense is called "clutching". The offense team may be "clutching" for any of several reasons for example: 1.) Offense team may only have defense cards in playing hand, making it necessary to play a defense card. 2.) Offense may play a defense card like a 15 ft jump shot no good card simply to see what the next card in the playing deck 8 will be. 3.) If the offense team plays a defense card (clutching), the defense player is not allowed to discard.

The game begins with a coin toss, the winner of which has several options. In a preferred embodiment, deal 10 cards (face down) from the playing deck 8 to each player. After analyzing his or her playing hand, the coin toss winner then declares whether he or she is going to play offense (having possession of the ball first) or playing defense (having the next possession when starting the second quarter). Then, deal all 12 cards (face down) from the passing deck to the player having first possession of the ball. Passing deck (all 12 cards) is then played alternately by the player having possession of the ball. To start, the offense player picks a "pass" card from his or her passing hand to engage the offense player to move the ball down the court to get in position to play a green offense "shot" card.

If the defense player chooses to play a card in response to the pass card, the defense card played against the pass card is played from defense player's hand (placing it face up in discard pile) thus leaving 9 cards in his or her playing hand. Defense player immediately picks up another card from the playing deck 8 to replenish his or her hand back to 10 cards. The offense player cannot play more than 2 pass cards in the "paint" area on his or side of the court. If more than 2 pass cards are played, it results into a 3 second violation and the possession of the ball is turned over to the opponent.

If the defense player does not have a defense card to steal the ball, play a jump ball 32 card, play a traveling 34 card, or play a foul card then offense player is allowed to move the game ball 108 the appropriate number of positions specified on the pass card.

When a pass card is played from the offense playing hand, the defense player has the option of moving one of its five defense team members on the defense side of the court in position to block the passing lanes and making it harder for the offense player to move down the court. One move for each pass card played is allowed and the move can be one to three positions away and/or through the defense team members.

If all 12 pass cards have been played and a shot card from the offense playing hand has not been played or be in position to be played, it results in the offense player turning the ball over to the defense player who now goes on offense (in relation to real basketball—the 24 second clock has run out).

After successfully playing pass cards down the court to get in position to play a green offense shot card, the offense player plays a green offense card from the offense playing hand (placing it face up in discard pile) thus leaving 9 cards in the offense playing hand. Offense player immediately picks up another card from playing deck 8 to replenish the playing hand back to 10 cards.

The defense player lets the offense player know if play is good—if not, defense player plays a red corresponding defense card against the offense card played. If defense player states play is good, offense player scores 2 or 3 points according to the type of shot card being played. Defense player then discards any offense or defense card of his or her choice—such discard does not effect offense play. A card is then drawn from playing deck 8 to add to the defense playing hand.

To counter offense play, the defense player selects red corresponding defense card and places it face up on discard pile. Play attempted by offense player's green card is then affected by action indicated on red card. Defense player draws one card from deck to add to playing hand. While on defense, you don't have to play the red corresponding card.

If defense player plays red corresponding defense card and the shot card is no good, it results into a "rebound" card having to be played from the rebound deck to see who will have next possession of the ball. When a shot no good card has been played the defense player picks a rebound card from the rebound deck (playing it face up in discard pile). If the rebound is a defense rebound the defense player now becomes the offense player and then plays a pass card to move down the court to get in position to play a shot card. On a defense rebound the first pass card must be played from the "paint" area. If the rebound card played is an offense rebound the offense player gets to play any shot card in his or her playing hand and the game proceeds as described above.

Play continues as described above, in each of the four quarters of the game, until all of the cards from the playing deck 8 have been played.

Each player must have 10 cards in his or her playing hand before a play can be made and also before the coin toss winner decides whether to go on offense (having possession of the ball first) or go on defense (having the next possession when starting the second quarter). Each player must not have more than 10 cards in his or her playing hand. If an offense or defense player already has 10 cards in his or her playing hand and then picks an 11th card, the opposing player has the opportunity to discard a card from the opponent's playing hand without observing the other player's hand.

If a play is made by either the offense or defense player that is not in accordance with the rules of the game, it will result in that discard becoming nullified (i.e., not playable) and also result as an automatic turnover, if played by offense team.

The offense player always picks from the playing deck 8 first after a shot card has been played. Defense player must let opponent know if card played is good (i.e., defense player will not play a defense card to stop it) before defense player discards. When discarding after a successful play has been made, the defense team may discard any offense or defense card in his or her playing hand. At any time, when on offense, if it should be advantageous, or if you only have defense cards in your hand, you can play defense cards against yourself as long as they agree with the rules of the game. Once a card is laid down and released from a player's hand, it cannot be picked back up. That card must be played out. "A card laid is a card played".

When playing a pass card no movement along the passing lanes at right angle or left angle 90 degrees or more can be played. When playing a pass card, diagonal moves along the passing lanes less then 90 degrees can be played (in relation to real basketball these diagonal passes are considered deflected passes).

Options on which shots can be taken or played is indicated on each of the green offense cards and there is no exception to this rule. Options on which defense cards can be played on any green offense cards are indicated on each of the red corresponding cards and there is no exception to this rule. Options on which defense cards can be played on any orange pass cards are indicated on each of the red defense cards and there is no exception to this rule.

The passing deck is shuffled at the beginning of each possession (or when all cards in the deck have been played). The foul shooting deck is shuffled only at the beginning of each quarter (or when all cards in the deck have been played). After all the cards in the playing deck 8 have been played, a quarter has ended and the cards will then be reshuffled for the next quarter. The cards remaining in your hand are not reshuffled. This only applies to the cards in the playing deck 8. At the end of the second quarter the remaining cards in each player's hand will be returned to the deck to be reshuffled to start anew for the second half. At the end of the first and third quarters, the playing deck 8 will be reshuffled, but each player must keep the remaining cards in his or her hand.

When a shooting foul 38 shot card has been played by a defense player on a green offense shot card the offense player gets to play 2 foul shot cards from the foul shooting deck to see if he or she scores one or two points.

When a shooting foul 38 shot card has been played by a defense player on a green offense shot card that shot is considered to be missed and no good. When a shooting foul 38 shot card has been played by a defense player on a green offense shot card that shot is considered to be good (the basket counts) only when the point differential between both players is 6 or less points and the offense player gets to play one foul shot from the foul shooting deck to see if he or she scores one additional point.

When a shooting foul 38 shot card has been played by a defense player on a green offense 3 point shot card 60 the offense player gets to play 3 foul shot cards from the foul shooting deck to see if he or she scores one, two or three points.

When a shooting foul 38 shot card has been played by an offense player in a "clutching" situation the shooting foul 38 automatically becomes a non-shooting foul and the ball will be put into play by the offense player from the sideline in bounding area.

When a technical foul 40 card has been played by a defense player on a green offense shot card or an orange pass card the offense player gets to play one shot card from the foul shooting deck to see if he or she scores one point and the offense player then inbounds the ball from the sideline in bounding area to retain possession of the ball.

When an illegal defense 42 card has been played by a defense player on a green shot card or an orange pass card the offense player gets to retain possession and inbounds the ball from the sideline in bounding area. When an illegal defense 42 card has been played twice or more by a defense player on a green shot card or an orange pass card it results into a technical foul and the procedure above is repeated.

When a foul shot no good 24 card is played by an offense player the missed foul shot is automatically rebounded by the defense player.

When a technical foul 40 shot card or an illegal defense 42 card has been played by an offense player in a "clutching" situation the technical foul or the illegal defense will result in the offense player retaining possession of the ball then inbounds the ball from the sideline in bounding area but the offense player does not get to take or play a foul shot.

When a violation has occurred by a defense player playing a red defense card against an offense player's green shot card or an orange pass card resulting into a turnover the ball will be in bounded from the sideline in bounding area. The sideline in bounding area is designated as any of the five positions on either sideline of the basketball court from the point (space) the turnover occurred.

After a successful shot card has been played by an offense player the ball is in bounded and put into play from the baseline in bounding area. The baseline in bounding area is designated as any of the four spaces (peg holes) on either side of the baseline where the shot was scored on that side of the basketball court.

Time-out can only be called and played before a play is made. Your opponent cannot call time-out after you have made a play. Each player can only call one time-out for each quarter of the game. One time-out by each player can be called in each overtime period. When a player calls time-out, the opposing player has the option to take a break without a time-out being charged or recorded to him.

When an overtime occurs because the score is tied after all of the cards in the playing deck 8 have been played, the playing deck 8 will be reshuffled including the remaining playing cards in your hand. To start the overtime, 50 playing cards from the playing deck 8 will be used for each overtime period and procedures stated above are repeated.

What is claimed is:

1. A method of playing a game comprising the steps of providing a deck of passing cards, a deck of rebound cards, a deck of foul shot cards and a deck of playing cards, wherein at least a portion of the passing deck, the rebound deck, and the playing deck carries instructions for their use to replicate the progress of a basketball game;

dealing a like plurality of cards from the playing deck to each of two players;

declaring an offense player and a defense player, wherein the plurality of cards dealt to the offense player are an offense playing hand and the plurality of cards dealt to the defense player are a defense playing hand;

dealing the passing deck of cards to the offense player;

wherein the passing deck of cards comprises a plurality of pass cards, each having a type of pass accompanied with an instruction indicating the advancement of the offense player, selected from the group consisting of:
bounce pass,
chest pass,
cross court pass,
full court pass,
behind the back pass, and
alley oop pass;

wherein the rebound deck of cards comprises a plurality of rebound cards being selected from the group consisting of:
offensive rebound, and
defensive rebound;

wherein the foul shot deck of cards comprises a plurality of foul shooting cards being selected from the group consisting of:
foul shot no good, and
foul shot good;

wherein the playing deck of cards comprises a plurality of situation play cards, a plurality of offense cards and a plurality of defense cards, wherein the plurality of situation play cards, each situation play card having an instruction concerning a movement, an action or a shot, are selected from the group consisting of:
steal,
block shot,
jump ball,
traveling,
non-shooting foul,
shooting fouls
technical foul, and
illegal defense;

wherein the plurality of offense cards each having a type of shot selected from the group consisting of:
lay up,
slam dunk,
jump hook,
sky hook,
10 foot jump shot,
15 foot jump shot,
20 foot jump shot, and
3 point shot;

wherein the plurality of defense cards each having a type of shot that is no good corresponding to one of said types of shots on said offense cards selected from the group consisting of:
lay up no good,
slam dunk no good,
jump hook no good,
sky hook no good,
10 foot jump shot no good,
15 foot jump shot no good,
20 foot jump shot no good, and
3 point shot no good;

playing a pass card from the passing deck of cards, wherein the pass card is played by the offense player to indicate movement by the offense player according to instructions on the pass card played.

2. A method as in claim 1, further comprising:

providing a basketball game board having a representation of a basketball court thereon including two basketball goals, a center court position, two paint areas, a plurality of playing positions, wherein each of said plurality of playing positions being connected to other of the playing positions by a plurality of connecting lines, wherein any two playing positions are connected only by a single line, said plurality of playing positions including a plurality of shot positions wherein the plurality of connecting lines represent passing lanes, providing a plurality of game pieces representing members of a defense team;

providing a game piece representing a game ball;

providing a tabular means to record points, fouls, shot attempts, blocks, steals, rebounds, and quarters.

3. A method as in claim 2, further comprising:

playing a situation play card from the defense playing hand wherein said situation play card having an instruction listing a certain type of pass corresponding to the type of pass on said played pass card, wherein the situation play card is played by the defense player;

drawing a replacement card from the playing deck, wherein the replacement card is drawn by the defense player; and turning the game ball over to the defense player in response to the situation play card, wherein the defense player becomes the offense player and the offense player becomes the defense player.

4. A method as in claim 3, further comprising:

playing a shooting foul shot card; wherein the shooting foul shot card is played by the defense player;

playing two foul shot cards from the foul shooting deck, wherein the two foul shot cards are played by the offense player.

5. A method as in claim 3, further comprising:

playing a shooting foul shot card; wherein the shooting foul shot card is played by the defense player; and discounting the point made by the defense player.

6. A method as in claim 3, further comprising:

playing a shooting foul shot card; wherein the shooting foul shot card is played by the defense player; and playing three foul shot cards from the foul shooting deck, wherein the two foul shot cards are played by the offense player.

7. A method as in claim 3, further comprising:

playing a shooting foul shot card; wherein the shooting foul shot card is played by the offense player; and putting the ball into play by the offense player.

8. A method as in claim 3, further comprising:

playing a technical foul shot card, wherein the shooting foul shot card is played by the defense player in response to a shot card or a pass card;

playing a foul shooting card, wherein the foul shooting card is played by the offense player.

9. A method as in claim 2, further comprising:

moving the game ball a specified number of positions along the passing lanes to one of said predetermined shot positions, wherein the game ball is moved by the offense player in accordance with a set of instructions on the pass card played;

moving one of the defense team members along the passing lanes in response to the game ball being moved by the offense player;

playing a shot card from the offense playing hand by the offense player, wherein the shot card having a type of shot corresponding to the type of shot represented by the predetermined shot position the game ball is on; and drawing a replacement card from the playing deck, wherein the replacement card is drawn by the offense player.

10. A method as in claim 9, further comprising:

discarding a card from the defense playing hand;

drawing a replacement card from the playing deck, wherein the replacement card is drawn by the defense player;

awarding the offense player a number of points indicated on the shot card played by the offense player; and turning the ball over to the defense player, wherein the defense player becomes the offense player and the offense player becomes the defense player.

11. A method as in claim 9, further comprising:

playing a defense card from the defense playing hand wherein said defense card having a type of shot that is no good corresponding to the type of shot on said shot card played by the offense player; and drawing a replacement card from the playing deck wherein the replacement card is drawn by the defense player.

12. A method as in claim 11, wherein the defense card is a shot no good card, further comprising:

playing a rebound card from the rebound deck, wherein the rebound card is a defensive rebound card and is played by the defense player; and turning the ball over to the defense player, wherein the defense player becomes the offense player and the offense player becomes the defense player.

13. A method as in claim 11, wherein the defense card is a shot no good card, further comprising:

playing a rebound card from the rebound deck, wherein the rebound card is an offensive rebound card and is played by the offense player; and playing a shot card, wherein the shot card is played by the offense player.

14. A method as in claim 2, wherein the offensive player can only play two pass cards while being positioned in the paint area.

15. A method as in claim 2, wherein the bounce pass card carries instructions to move the game ball any two positions, along the passing lanes, notwithstanding the presence of a defense player.

16. A method as in claim 2, wherein the chest pass card carries instructions to move the game ball two to three positions, along the passing lanes, away from the defense player.

17. A method as in claim 2, wherein the chest pass card carries instructions to move the game ball one to two positions, along the passing lanes, away from the defense player.

18. A method as in claim 2, wherein the cross court pass card carries instructions to move the game ball four to six positions, along the passing lanes, away from the defense player.

19. A method as in claim 2, wherein the full court pass card carries instructions to move the game ball six to ten positions, along the passing lanes, away from the defense player.

20. A method as in claim 2, wherein the behind the back pass card carries instructions to move the game ball two to three positions, along the passing lanes, away from the defense player, said behind the back pass card being played only in the paint area.

21. A method as in claim 2, wherein the alley oop pass card carries instructions to move the game ball three to six positions, along the passing lanes, notwithstanding the presence of a defense player.

22. A method as in claim 2, wherein the offensive rebound card carries instructions to play any shot without making a pass.

23. A method as in claim 2, wherein the defensive rebound card carries instructions that the game ball must be passed from any space in the paint area.

24. A method as in claim 2, wherein the steal card can be played in response to any pass card.

25. A method as in claim 2, wherein the block shot card is selected from the group consisting of: a block shot played in response to any shot except a three point shot card, a block shot played in response to any shot except a twenty foot jump shot card, and a block shot played in response to any shot card except a fifteen foot jump shot card.

26. A method as in claim 2, wherein the jump ball card can be played in response to any shot card.

27. A method as in claim 2, wherein the traveling card can be played in response to any pass card.

28. A method as in claim 2, wherein the non-shooting foul card can be played in response to any pass card.

29. A method as in claim 2, wherein the shooting foul card can be played in response to any shot card.

30. A method as in claim 2, wherein the technical foul card can be played in response to any shot card or any pass card, wherein when a foul shot card is played, the offense player retains possession of the game ball.

31. A method as in claim 2, wherein the illegal defense card can be played in response to any shot card or any pass card, wherein when the illegal defense card is played more than twice, a technical foul results.

32. A method as in claim 2, wherein the lay up card can only be played from a lay up position.

33. A method as in claim 2, wherein the slam dunk card can only be played from a slam dunk position.

34. A method as in claim 2, wherein the jump hook card can only be played from a jump hook position.

35. A method as in claim 2, wherein the sky hook card can only be played from a sky hook position.

36. A method as in claim 2, wherein the 10 foot jump shot card can only be played from a 10 foot jump shot position.

37. A method as in claim 2, wherein the 15 foot jump shot card can only be played from a 15 foot jump shot position.

38. A method as in claim 2, wherein the 20 foot jump shot card can only be played from a 20 foot jump shot position.

39. A method as in claim 2, wherein the 3 point shot card can only be played from a 3 point shot position.

40. A method as in claim 2, wherein the lay up no good card can only be played in response to a lay up card.

41. A method as in claim 2, wherein the slam dunk no good card can only be played in response to a slam dunk card.

42. A method as in claim 2, wherein the jump hook no good card can only be played in response to a jump hook card.

43. A method as in claim 2, wherein the sky hook no good card can only be played in response to a sky hook card.

44. A method as in claim 2, wherein the 10 foot jump shot no good card can only be played in response to a 10 foot jump shot card.

45. A method as in claim 2, wherein the 15 foot jump shot no good card can only be played in response to a 15 foot jump shot card.

46. A method as in claim 2, wherein the 20 foot jump shot no good card can only be played in response to a 20 foot jump shot card.

47. A method as in claim 2, wherein the 3 point shot no good card can only be played in response to a 3 point shot card.

48. A game system comprising:

a basketball game board having a representation of a basketball court thereon including two basketball goals, a center court position, two paint areas, a plurality of playing positions, wherein each of said plurality of playing positions being connected to other of the playing positions by a plurality of connecting lines, wherein any two playing positions are connected only by a single line, said plurality of playing positions including a plurality of shot positions wherein the plurality of connecting lines represent passing lanes;

a game piece representing a game ball;

a deck of passing cards, a deck of rebound cards, a deck of foul shot cards and a deck of playing cards, wherein at least a portion of the passing deck the rebound deck, and the playing deck carries instructions for their use to replicate the progress of a basketball game;

wherein the passing deck of cards comprises a plurality of pass cards, each having a type of pass accompanied with an instruction indicating the number of playing positions the game ball can advance selected from the group consisting of:
bounce pass,
chest pass,
cross court pass,
full court pass,
behind the back pass, and
alley oop pass;

wherein the rebound deck of cards comprises a plurality of rebound cards being selected from the group consisting of:
offensive rebound, and
defensive rebound;

wherein the foul shot deck of cards comprises a plurality of foul shooting cards being selected from the group consisting of:
foul shot no good, and
foul shot good;

wherein the playing deck of cards comprises a plurality of situation play cards, a plurality of offense cards and a plurality of defense cards, wherein the plurality of situation play cards, each situation play card having an instruction concerning a movement an action or a shot, are selected from the group consisting of:
steal,
block shot,
jump ball,
traveling,
non-shooting foul,
shooting foul,
technical foul, and
illegal defense;

wherein the plurality of offense cards, each having a type of shot corresponding to one of said types of shots represented by said shot positions, are selected from the group consisting of:
lay up,
slam dunk
jump hook
sky hook
10 foot jump shot,
15 foot jump shot, 20 foot jump shot, and 3 point shot;

wherein the plurality of defense cards, each having a type of shot that is no good corresponding to a type of shot on said shot cards, are selected from the group consisting of:

lay up no good, slam dunk no good, jump hook no good, sky hook no good, 10 foot jump shot no good, 15 foot jump shot no good, 20 foot jump shot no good, and 3 point shot no good.

49. A game system as in claim 48 further including:

a plurality of game pieces representing members of a defense team; and a tabular means to record points, fouls, shot attempts, blocks, steals, rebounds, and quarters.

* * * * *